US006342002B1

(12) United States Patent
Wang

(10) Patent No.: US 6,342,002 B1
(45) Date of Patent: Jan. 29, 2002

(54) STRUCTURE OF A WAX-POLISHING MACHINE

(75) Inventor: Frank Wang, Keelung (TW)

(73) Assignee: Double Dynasty Co., Ltd. (TW)

( * ) Notice: Subject to any disclaimer, the term of this patent is extended or adjusted under 35 U.S.C. 154(b) by 11 days.

(21) Appl. No.: 09/616,909

(22) Filed: Jul. 14, 2000

(51) Int. Cl.[7] ..... B24B 23/00; B24B 27/08
(52) U.S. Cl. ..... 451/359; 451/344
(58) Field of Search ..... 451/342, 344, 451/357, 358, 359, 360; 15/97.3, 21.1, 28, 29, 49.1, 50.1, 50.3, 52

(56) References Cited

U.S. PATENT DOCUMENTS

| | | | | | |
|---|---|---|---|---|---|
| 4,791,694 | A | * | 12/1988 | Itaya et al. | 15/97 R |
| D313,094 | S | * | 12/1990 | Itaya et al. | D32/1 |
| 5,056,186 | A | * | 10/1991 | Jiam-Fa | 15/328 |
| 5,231,727 | A | * | 8/1993 | Armbruster | 451/359 |
| 5,775,982 | A | * | 7/1998 | Paterno | 451/359 |
| 6,290,587 | B1 | * | 9/2001 | McCracken et al. | 451/357 |

* cited by examiner

*Primary Examiner*—Derris H. Banks
(74) *Attorney, Agent, or Firm*—Troxell Law Office PLLC

(57) ABSTRACT

An improved structure of a wax-polishing machine, which mainly comprises a fixed disk mounted on the front end of the body portion of the polishing machine; the disk surface of the fixed disk is mounted with a bearing, of which the inner edge is in contact with the outer surface of an inner driven gear; between the inner driven gear and the transmission shaft of the polishing machine, there are an idle gear and a driving gear mounted therein; the outer edge surface of the inner driven gear is in close contact with an outer rotation disk; the center of the outer rotation disk has a cylindrical hole for receiving a post body of the inner rotation disk, and then the post body can be screwed on the outer end of the transmission shaft; the inner surface of the inner rotation disk and the outer surface of the outer rotation disk are glued with Velcro pads respectively so as to facilitate sponge pieces with Velcro pads to be fastened together; when the transmission shaft of the polishing machine is actuated, the driving gear will drive the idle gear and the inner driven gear to transfer power to the inner and outer rotation disks, which will drive the polishing sponge pieces to turn in different direction so as to remove the wax coated on a cat body and to polish the same simultaneously.

3 Claims, 5 Drawing Sheets

STRUCTURE OF A WAX-POLISHING MACHINE

BACKGROUND OF THE INVENTION

1. Field of the Invention

This invention relates to a polishing machine, and particularly to the structure of a wax-polishing machine.

2. Description of the Prior Art

The conventional wax-polishing machines may be classified into two kinds, i.e., an electro-motive type and a pneumatic type. The two types are using electric power and a high-pressure air respectively to drive the rotors to turn; and then such turn will be transformed into a high torsion and a low speed output to actuate the polishing machine to polish the surface of a car with wax.

The rotation disk on the front end of the polishing machine includes a single round shaft connected pivotally with a transmission shaft; the surface of the rotation disk is usually mounted with a cloth-type-polishing member or a sponge-polishing member. The machine is driven with a high torsion and a low speed power so as to have the polishing member contacted with the car surface, and to remove wax coated on the car surface and to polish the same.

Since the conventional polishing machine has a single round shaft to connect pivotally with a transmission shaft, the surface of the rotation disk can rotate in one direction only; after wax is put on a car, a polishing person uses a hand to coat (in a rotary manner) wax on a car slowly; such a way of coating wax and polishing take a quite long time.

SUMMARY OF THE INVENTION

The prime object of the present invention is to provide a structure for a wax-polishing machine, in which the front end of the transmission shaft of the polishing machine is mounted with a driving gear and an inner rotation disk; the inner rotation disk is mounted in the center of an outer rotation disk, which is connected, by means of screws, with the outer edge of an inner driven gear; an idle gear is mounted between the inner driven gear and a driving gear; when the transmission shaft of the body portion rotates, the inner and outer rotation disks will be driven to rotate, and then the inner and outer sponge pieces will also rotate in different directions.

Another object of the present is provide a structure for a wax-polishing machine, in which the transmission shaft is mounted with a driving gear, and the outer edge of the driving gear is fixedly screwed in a center cylindrical hole of the inner rotation disk; the surface of the inner rotation disk is glued with a Velcro pad to be connected with another Velcro pad attached with a polishing sponge piece; a power can directly be transferred to the sponge piece by means of the transmission shaft.

Still another object of the present invention is to provide a structure for a wax-polishing machine, in which one side of the driving gear on the transmission shaft is engaged with an idle gear which is then engaged with an inner driven gear; the outer edge of the inner driven gear is connected together with an outer rotation disk by means of screws; the outer surface of the outer rotation disk is mounted with a Velcro pad to be glued with another Velcro pads on the bottom of a polishing sponge piece; the inner driven disk can transfer power to the polishing sponge piece on the outer surface.

A further object of the present invention is to provide a structure for a wax-polishing machine, in which the Velcro pads attached to the inner and outer rotation disks facilitate the polishing sponge pieces to mount or dismount, if necessary.

A still further object of the present invention is to provide a structure for a wax-polishing machine, in which two replaceable polishing sponge pieces are furnished on a detachable basis; for waxing operation, the outer sponge piece may be removed, and then the inner sponge piece can be used to rotate so as to coat wax on a car quickly.

Yet another object of the present invention is to provide a structure for a wax-polishing machine, in which two replaceable polishing sponge pieces are furnished on a detachable basis; for waxing operation, the inner sponge piece may be dismounted and replaced with a lower sponge piece; then, the space left with the lower sponge piece can be used for putting additional wax therein so as to supply more wax for later coating.

Yet still another object of the present invention is to provide a structure for a wax-polishing machine, in which two replaceable sponge pieces are furnished; for polishing operation, the inner and outer sponge pieces can rotate at different linear speed so as to finish the polishing operation rapidly.

DETAILED DESCRIPTION OF THE PREFERRED EMBODIMENT

Figure 1:
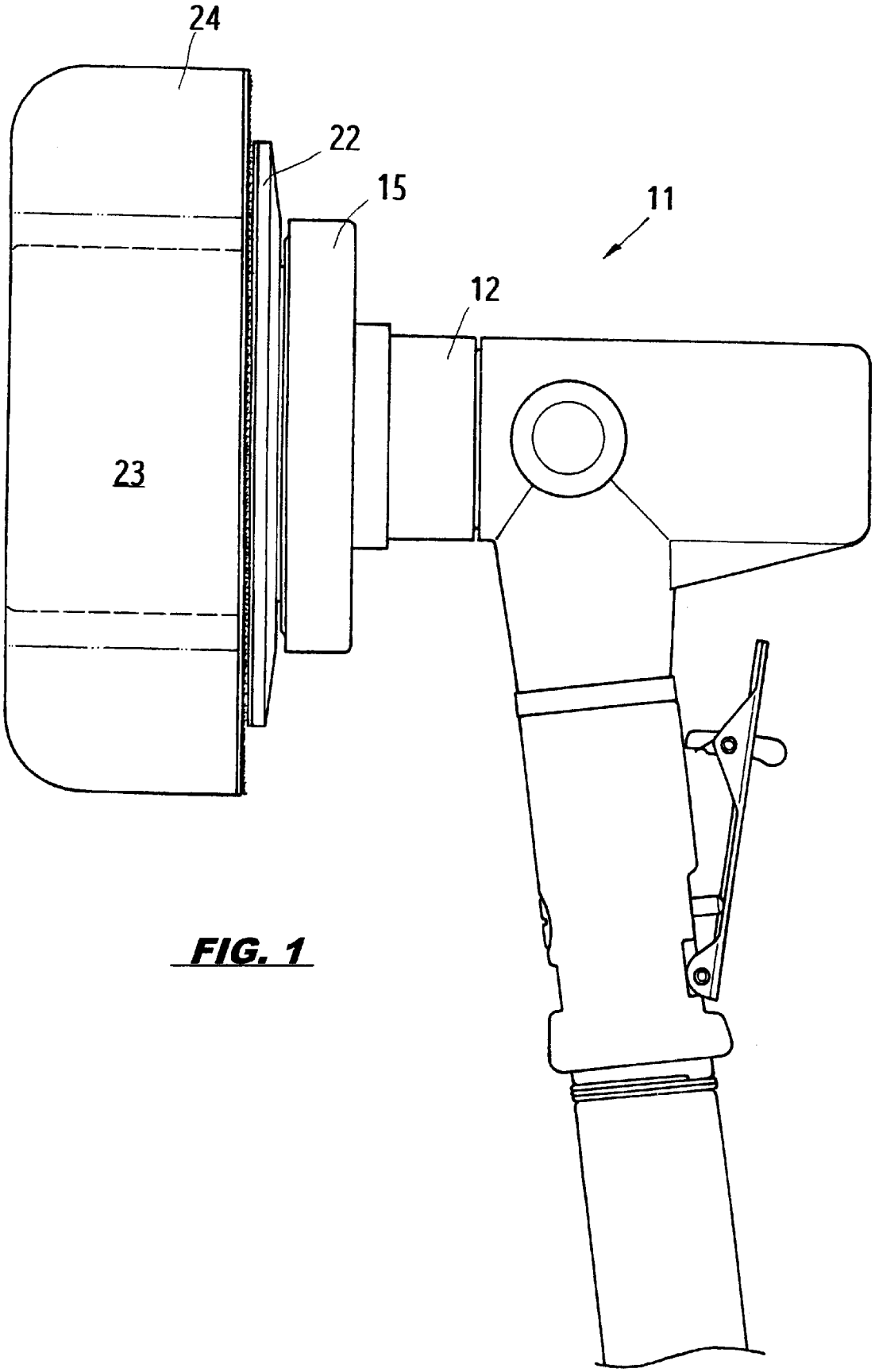
FIG. 1 is a plan view of the present invention, showing an outer structure of the polishing machine thereof.
Figure 2:
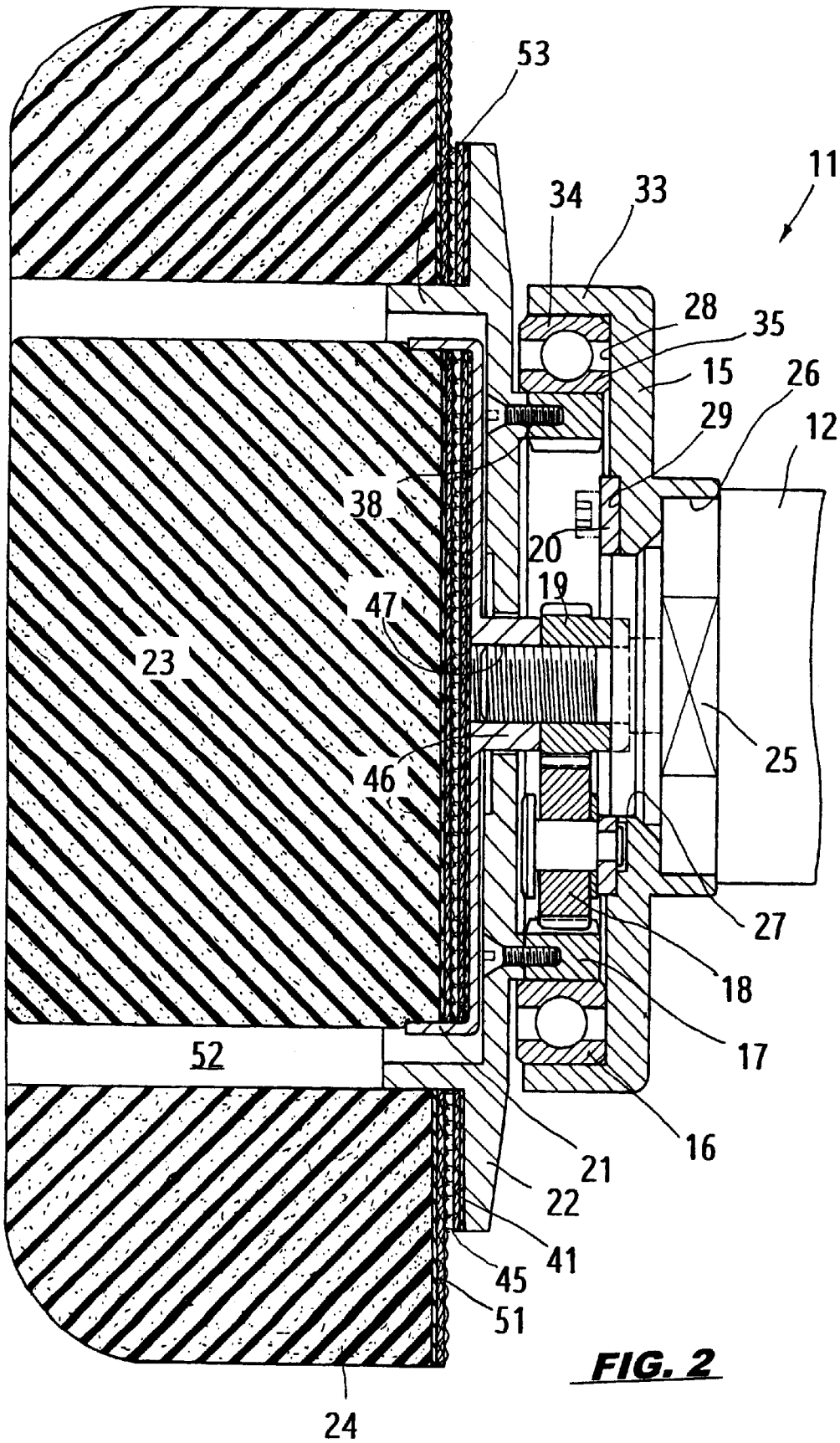
FIG. 2 is a sectional view of the present invention, showing the outer transmission structure of the polishing machine.
Figure 3:
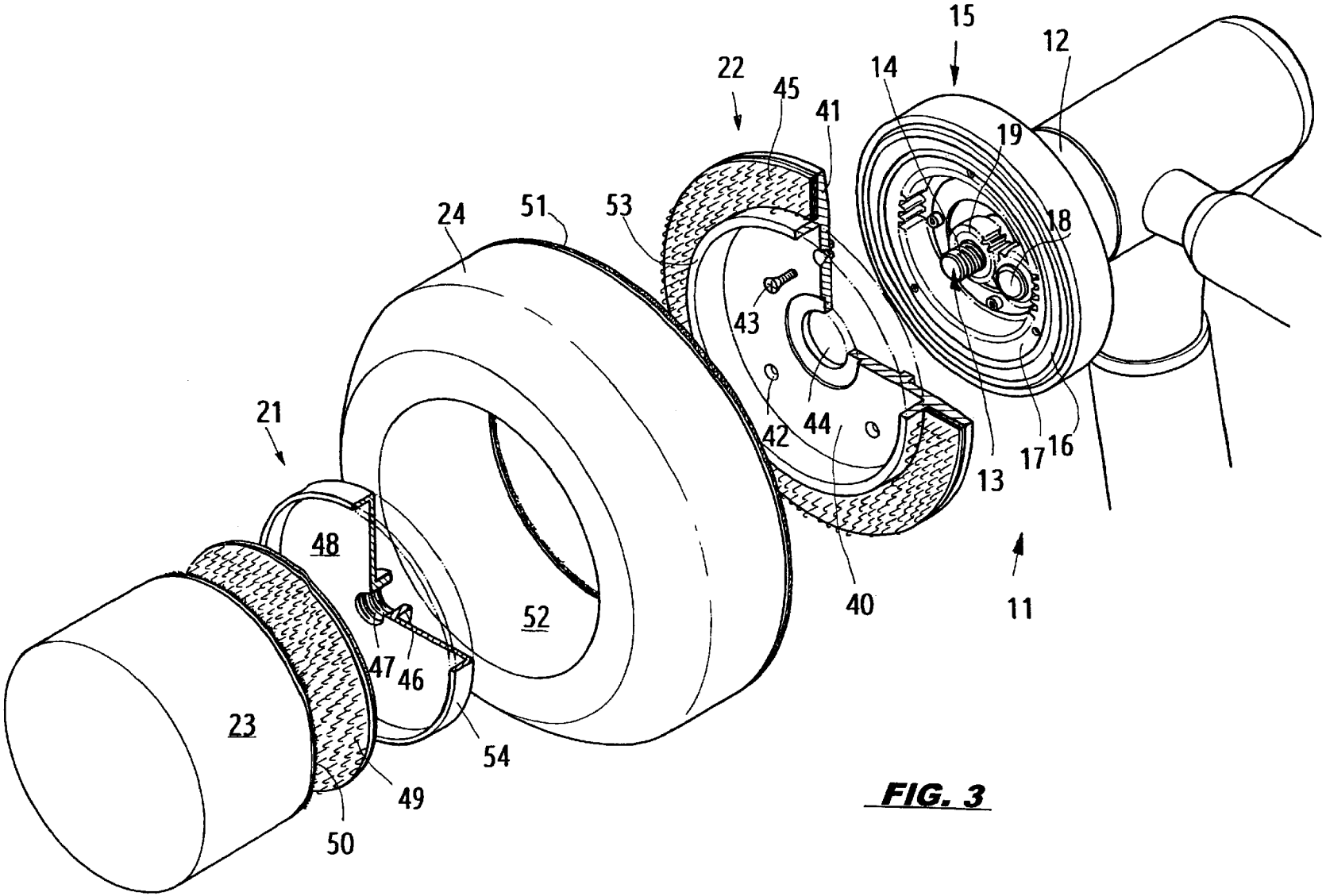
FIG. 3 is a disassembled view of the present invention, showing the structure of the polishing members thereof.
Figure 4:
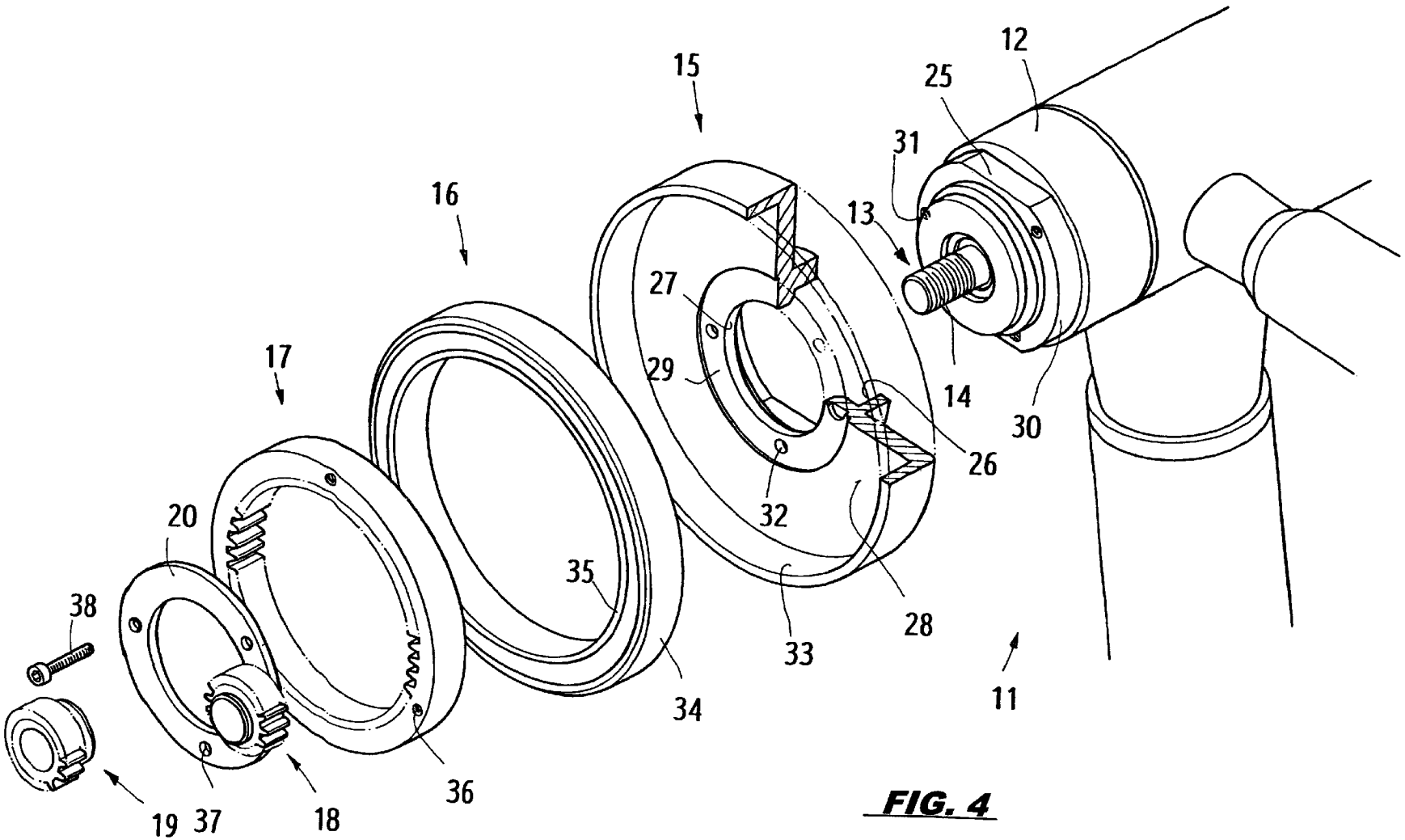
FIG. 4 is a sectional view of the present invention, showing the transmission structure of the polishing machine.
Figure 5:
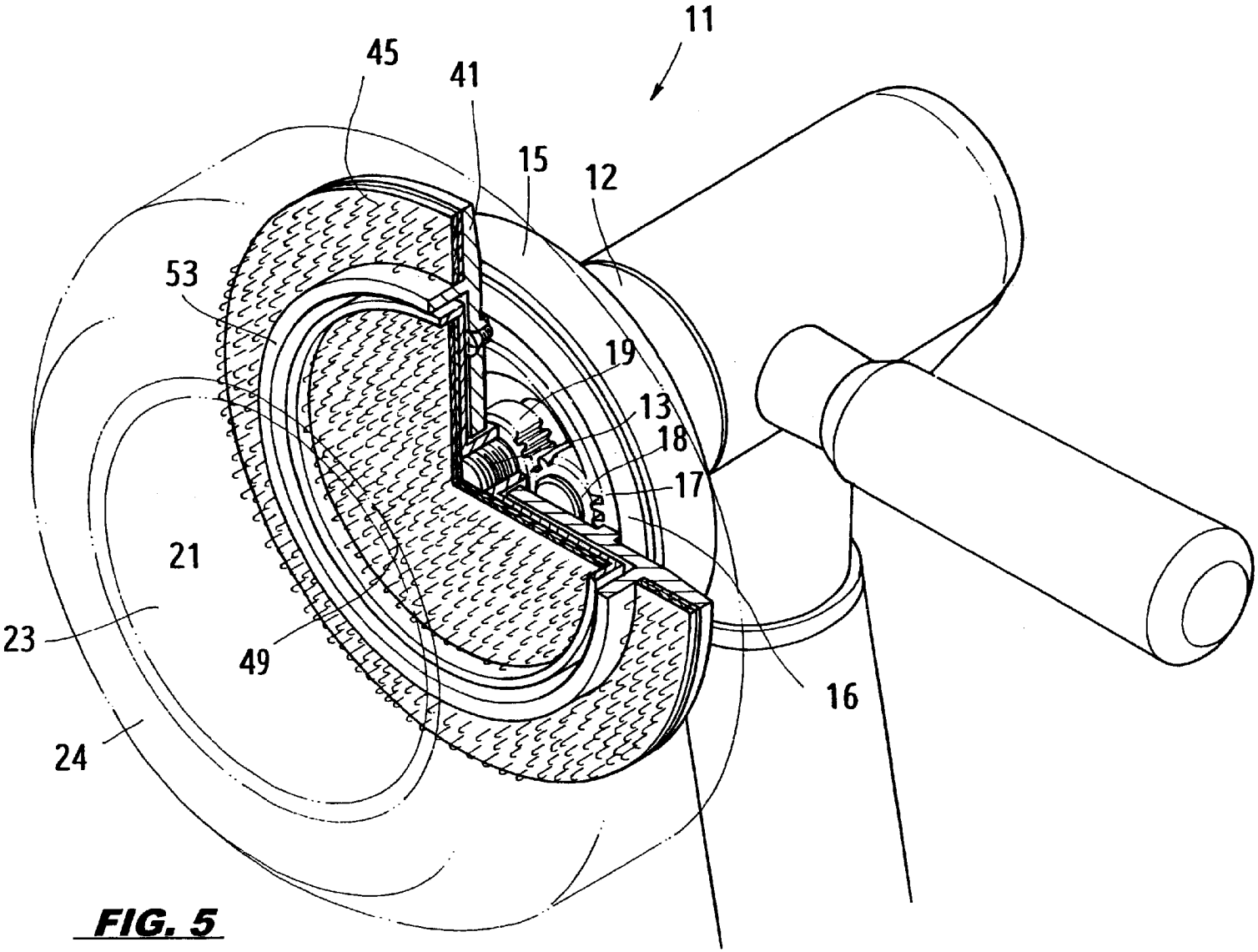
FIG. 5 is a sectional view of the present invention, showing the relation between the polishing members and the transmission parts thereof.

Referring to FIGS. 1 and 4, the present invention relates to a structural improvement of a polishing machine; the main feature thereof is that the inner portion of the body portion 12 of the polishing machine is provided with a retarding gear train, through which a high-pressure air power or an electromotive force can be transmitted to the transmission shaft 13 so as to provide a low speed and a high torsion power. The transmission shaft 13 is mounted with a driving gear 19; the outer edge of the shaft is connected, through threads, with a center post body 46 of an inner rotation disk 21 so as to transfer power to the inner rotation disk 21 directly. One side of the transmission shaft 13 is engaged with an idle gear 18 which is engaged with an inner driven gear 17, of which the outer edge is mounted with an outer rotation disk 22. Power ca be transmitted to the outer rotation disk 22 through the driving gear 19, the idle gear 18 and the inner driven gear 17; the surfaces of the inner rotation disk 21 and the outer rotation disk 22 are glued with Velcro pads 45 and 49 respectively to facilitate an inner and outer sponge pieces 23 and 24 to be glued thereon. When the transmission shaft 13 rotates, the inner and outer sponge pieces 23 and 24 for polishing will rotate in different directions in order to provide a polishing work on a car body at different speed.

Referring to FIGS. 1 to 5, the round cylinder 30 on the front end of the body portion of the polishing machine 11 is furnished with two symmetrical surfaces 25 to be mated with a sleeve cylinder 26 of a fixed disk 15; the center of the fixed disk 15 has a cylindrical hole 27 with a suitable diameter; the round edge of the cylindrical hole 27 is furnished with an inner round surface 29 having a plurality of through holes 32. The inner round surface 29 is mounted with a fastening ring 20 riveted with an idle gear 18. Screws can be set through the through holes 37 of the fastening ring 20, the through holes 32 of the inner disk surface 29 and the screw holes 31 of the body portion 12 so as to fasten the three parts together. Before the fixed disk 15 and the body portion 12 are assembled together, the outer edge of the disk surface 28 with a ring-shaped plate 33 having a suitable height and an inner diameter must be assembled together with an outer bearing member 34 of a bearing 16. Before the bearing 16 and the fixed disk 15 are assembled together, an inner driven gear 17 and an inner bearing member 35 of the bearing 16 must be assembled together; then, the bearing 16 is mounted on the ring-shaped plate 33 of the fixed disk 15. After the fixed disk 15 is mounted on the front end of the body portion 12, the inner driven gear 17 and the bearing 16 will be mounted to the inner disk surface 29 of the fixed disk 15 by means of a fastening ring 20; finally, screws 38 are used for fastening the fastening ring 20 and the fixed disk 15 to the front end of the body portion 12.

The fixed disk 15 has a cylindrical hole 27 in the center thereof, and the diameter of the hole 27 is larger than that of the outer diameter of the driving gears 19. After the fixed disk 15 is mounted on the front end of the body portion 12, the transmission shaft 13 will pass through the cylindrical hole 27 of the fixed disk 15; the transmission shaft 13 has a given length, and the outer end thereof has outer threads 14; the shaft 13 is to be mounted with the driving gear 19 through the shaft hole thereof. The outer threads 14 are to be mated with the inner threads 47 of the post body 46 of the inner rotation disk 21. After the driving gear 19 is screwed on the transmission shaft 13, the power applied to the transmission shaft 13 will be transferred to the inner rotation disk 21; further, the power will also be transmitted to the outer rotation disk 22 via the driving gear 19, the idle gear 18 and the inner driven gear 17 so as to provide two different output of power.

The inner rotation disk 21 is to be mounted on the transmission shaft 13; the surface of the inner driven gear 17 on the outer edge the fixed disk 15 is furnished with a plurality of thread holes 36. The surface of the inner driven gear 17 is mounted with an outer rotation disk 22 by using a plurality of screws 43; the outer rotation disk 22 includes an inner disk surface 40 and an outer disk surface 41 partitioned by means of a ring-shaped plate 53. The center of the inner disk surface 40 is furnished with a cylindrical hole 44 having a suitable diameter; the inner disk surface is furnished with a plurality of sunk screw holes 42 for receiving screws 43 upon the outer rotation disk 22 being fastened in place; the screws 43 and the inner disk surface 40 are all on a same horizontal surface. The outer disk surface 41 outside the ring-shaped plate 53 has a suitable width extended outwards. The outer disk surface 41 is glued with a Velcro pad 45 which is made of a knitted pad with a plurality of thermoplastic single threads to be cut into a plurality of tiny hooks, i.e., a piece of rug to provide a fastening function.

The outer rotation disk 22 is fixedly mounted on the outer edge of the inner driven gear 17; the center cylindrical hole 44 of the outer rotation disk 22 is used for receiving the post body 46 furnished with inner threads 47. When the inner threads 47 of the post body 46 are mated together with the outer threads 14 of the transmission shaft 13, the driving gear 19 will be fixedly mounted on the transmission shaft 13. The outer edge of the inner rotation disk 21 is furnished with a ring-shaped plate 54 having a suitable height; the inner disk surface 48 of the ring-shaped plate 54 is to be glued with a round Velcro pad 49, which is made of a knitted pad with a plurality of thermoplastic single threads to be cut into a plurality of tiny hooks, i.e., a piece of rug to provide a fastening function.

After all transmission parts of the polishing machine 11 are mounted on the front end of the body portion 12, the fixed disk 15 is obviously divided into two independent disk surfaces (i.e., a Velcro pad and a round Velcro pad 45 and 49). The outer disk surface is mounted with a sponge piece 24 attached with a Velcro pad 51, of which the surface is furnished with an adhesive pile to be glued together with the Velcro pad 45 furnished with tiny hooks. The inner disk surface is glued with a Velcro pad 50 attached with a sponge piece 23; the adhesive pile of the Velcro pad 50 is to be glued together with the Velcro pad 49 which has a tiny hook surface. The height and kind of the sponge pieces 23 and 24 attached to the inner and outer rotation disks 21 and 22 respectively are varied in accordance with the uses desired.

The front end of the body portion 12 of the polishing machine 11 is mounted with the transmission parts respectively. When the transmission shaft 13 has an output of low speed and a high torsion, the inner sponge piece 23 of the inner rotation disk 21 is connected together with the transmission shaft 13 by means of the post body 46 of the disk 21 so as to be driven with the transmission shaft 13. The outer sponge piece 24 on the outer rotation disk 22 can rotate in different directions because that the outer rotation disk 22 and the outer edge of the inner driven gear 17 are connected together, and the outer surface of the inner driven gear 17 is mounted in the bearing 16 before being fixed to the fixed disk 15, and then the driving gear 19 and the idle gear 18 are engaged with the inner rotation gear 17 so as to have the power on the transmission shaft 13 transferred to the outer rotation disk 22.

When waxing and polishing a car body, there is a way in which the outer sponge piece 24 is removed from the machine. The car body is coated with a suitable amount of cured wax, or the cured wax is applied to the inner sponge piece 23, and then actuate the transmission shaft 13 so as to have the cured wax on the sponge piece coated on the car body; there is another way, in which a lower height of inner sponge piece 23 is used; a suitable amount of cured wax is put in the cylindrical hole 52 of the outer sponge piece 24, and let the outer surface of the outer sponge piece 24 contact with the car body; when the outer sponge piece 24 is moving and rotating, the cured wax in the cylindrical hole 52 will be supplied to the car body for proper wax polishing.

After the cured wax on car body is dry, select and glue the sponge pieces 23 and 24 to the inner and outer rotation disks 21 and 22 respectively by means of the Velcro pads 50 and 51 so as to have the adhesive pile and the tiny hooks on the Velcro pads mated together. The inner sponge piece 23 is mounted in the cylindrical hole 52 of the outer sponge piece 24; when the motor in the body portion 12 of the polishing machine 11 is driven to turn, the two sponge pieces 23 and 24 will rotate in different direction, and will contact the body portion at different linear speed so as to remove the wax on the car body, and to have the car polished.

According to the aforesaid description of the embodiment, the features and structure of the present invention have been disclosed completely; it is obvious that the present invention has provided a prominent improvement, which is never anticipated and accomplished by any person in the same field, and the structure thereof is deemed unique.

What is claimed:

1. An improved structure of a wax-polishing machine, comprising a fixed disk mounted on a transmission shaft on front end of a body portion of said polishing machine; a surface of said fixed disk mounted with a bearing, of which inner surface being mounted with an inner driven gear; said transmission shaft in center of said fixed disk mounted with a driving gear, and an idle gear being mounted between said driving gear and said inner driven gear, and features thereof being described as follows:

Outer surface of said inner driven gear and an inner surface of an outer rotation disk being connected together by means of screws; a ring-shaped plate dividing a surface into an inner disk surface and an outer disk surface; and said outer disk surface glued with a Velcro pad furnished with tiny hooks, and said Velcro pad to be glued with an outer sponge piece attached to a Velcro pad furnished with an adhesive pile; center of said inner disk surface of said ring-shaped plate furnished with a cylindrical hole for receiving a post body of an inner rotation disk, and inner threads of said post body to be mated with outer threads of said transmission shaft; surface of said inner rotation disk being mounted on an inner disk surface in said ring-shaped plate of said outer rotation disk; surface of said inner rotation disk glued with a Velcro pad furnished with tiny hooks to be attached with a Velcro pad furnished with an adhesive pile on an inner sponge piece; when said transmission shaft rotating to drive a gear train, said inner rotation disk and said outer rotation disk able to rotate in different direction, and then said Velcro pads having tiny hooks attached with said inner and outer sponge pieces able to rotate at different speed to perform waxing and polishing operation for a car body.

2. An improved structure of a wax-polishing machine as claimed in claim 1, wherein center of said outer sponge piece on said outer rotation disk is furnished with a cylindrical space being larger than said inner sponge piece for mounting said inner sponge piece therein; said inner and outer sponge pieces furnished with adhesive piles respectively so as to mate and glue to said tiny-hook Velcro pads on said inner and outer rotation disks.

3. An improved structure of a wax-polishing machine, comprising a transmission shaft on front end of said polishing machine, and outer edge of said transmission shaft furnished with a post body and a cut surface for mounting a fixed disk, and features thereof being described as follows:

Outer edge of said fixed disk on said transmission shaft having a ring-shaped plate, of which inner space being mounted with an outer bearing member of bearing mated together with an inner driven gear; said inner driven gear mated together with an inner bearing member of said bearing; center of said fixed disk furnished with an inner disk surface to be riveted with a fastening ring mounted with an idle gear; said fastening ring and said fixed disk being fixedly mounted on front end of said body portion by using screws to pass through holes in said fastening ring and said fixed disk respectively; said transmission shaft mounted with a driving gear; said driving gear and said inner driven gear being engaged through said idle gear; outer edge of said inner driven gear and an inner disk surface of an outer rotation disk being connected together by using screws; front end of said transmission shaft to be mated with inner threads of a post body of said inner rotation disk so as to have said driving gear fixedly mounted to said transmission shaft; surfaces of said inner rotation disk and said outer rotation disk attached with Velcro pads furnished with tiny hooks respectively so as to have Velcro pads having adhesive piles glued thereto, and said adhesive piles being attached with inner and outer sponge pieces; through said driving gear, power of said transmission shaft able to drive said inner and outer rotation disks to rotate in different direction via said idle gear and said inner driven gear.

* * * * *